US005556019A

United States Patent [19]

Morris

[11] Patent Number: 5,556,019

[45] Date of Patent: Sep. 17, 1996

[54] BAG SEPARATOR AND DISPENSER

[75] Inventor: Joseph W. Morris, Hartsville, S.C.

[73] Assignee: Sealed Air Corporation, Saddle Brook, N.J.

[21] Appl. No.: 279,912

[22] Filed: Jul. 25, 1994

[51] Int. Cl.[6] ..... B26F 3/02; B65H 35/10

[52] U.S. Cl. ..... 225/96; 225/106; 242/423.2

[58] Field of Search ..... 225/96, 51, 33, 225/91, 39, 47, 106; 242/423.2, 570, 598, 598.3, 598.4, 598.5, 598.6, 599.3

[56] References Cited

U.S. PATENT DOCUMENTS

| | | | |
|---|---|---|---|
| 1,122,674 | 12/1914 | Winter et al. | 225/51 |
| 1,434,040 | 10/1922 | Bullock | 225/33 |
| 1,912,363 | 6/1933 | De Waide | 225/106 |
| 2,304,312 | 12/1942 | Meglitz | 225/47 |
| 2,414,915 | 1/1947 | Ziegler | 225/47 |
| 2,452,299 | 10/1948 | Gould | 225/47 |
| 3,062,424 | 11/1962 | Stirrup | 225/47 |
| 3,494,518 | 2/1970 | Goss | 225/34 |
| 3,702,672 | 11/1972 | Becht | 225/106 |
| 4,454,974 | 6/1984 | Cooke | 225/106 |
| 4,771,966 | 9/1988 | Anderson | 225/51 |
| 5,118,022 | 6/1992 | Farahnik | 225/106 |
| 5,135,146 | 8/1992 | Simhaee | 225/80 |
| 5,170,957 | 12/1992 | Carpenter | 242/55.63 |
| 5,207,368 | 5/1993 | Wilfong, Jr. et al. | 225/106 |
| 5,209,371 | 5/1993 | Daniels | 221/63 |
| 5,219,424 | 6/1993 | Simhaee | 225/47 |
| 5,261,585 | 11/1993 | Simhaee | 225/47 |
| 5,307,969 | 5/1994 | Menendez | 225/42 |

*Primary Examiner*—Kenneth E. Peterson
*Assistant Examiner*—Sean A. Pryor
*Attorney, Agent, or Firm*—Bell, Seltzer, Park & Gibson, P.A.

[57] ABSTRACT

A bag dispenser, for separating and dispensing a series of plastic bags where one end is attached to the top of the next bag by perforation lines with a slot therebetween. The series of bags are dispensed from a device comprising a wire frame formed into channels to support the core that the series of bags are rolled onto. The channels allow the core to rotate in place but restrict its linear movement to the vertical direction. The dispenser has two braking devices, a braking bar underneath the roll of bags and a pair of fingers that are attached to the channels to engage the core. The braking bar is positioned transversely to the series of bags so that it supports them. The pair of fingers does not engage the core until the number of bags on the core has decreased and the core has begun to descend. The two braking devices work in combination to retard the rotation and dispensing of the bags and thus to apply a tension to the series of bags. Attached to the frame is a separator with, preferably, a symmetric projection on its end. The projection will engage the slot regardless of whether the bags are drawn over or under the projection. Additionally, the separator is preferably coiled in its midsection to function as a spring. As the user pulls on the bags, a tension is created by the braking devices and the user to deflect the separator which remains deflected until the projection engages the slot. Thus, when the separator engages the slot, the separator recoils through its normal position to facilitate the separation of the two bags.

6 Claims, 2 Drawing Sheets

BAG SEPARATOR AND DISPENSER

BACKGROUND OF THE INVENTION

1. Field of the Invention

The present invention relates generally to devices for dispensing a series of articles and more specifically relates to plastic bag dispensers where each bag is separated from a roll of bags.

2. Discussion of Background

In supermarkets and other types of food markets, fruits, vegetables, and other produce are displayed in bulk, on tables or in open coolers along the walls. Plastic bags are provided for consumers who want them for their produce selections. The most common way to dispense these produce bags is on cylindrical rolls mounted horizontally or vertically. The top of each bag is attached to the bottom of the next bag. Each bag may be separated from the next along a perforated line that defines the end of one bag and the start of the next bag. By grabbing a bag with one hand and the next bag with the other hand, and then pulling, the consumer can separate the two bags along the perforation line. Sometimes consumers will tear or stretch the bags when trying to separate them or attempt to simply jerk the bag frown the roll causing it to unravel. Additionally, after a bag has been taken from the roll, the next bag may lie flat on the surface of the roll, making it very difficult to find or peel from the roll. Moreover, removing bags from a roll of bags is a two-handed task.

Simhaee, in U.S. Pat. Nos. 5,261,585, 5,219,424, and 5,135,146, discloses plastic bag dispensers that enable the consumer to tear the bags with one hand without the bags unraveling by pulling the bags across a single finger. This improvement facilitates the separation of the bags; however, there is still a need for further improvement. These bag dispensers must be carefully mounted to surfaces so that they are properly oriented for dispensing bags. Furthermore, there is a need to provide a bag dispenser that is easy to clean and maintain. Therefore, there is still a need to develop a bag dispenser that operates smoothly, is easy to use, and can be easily mounted in various orientations.

SUMMARY OF THE INVENTION

According to its major aspects and briefly described, the present invention is a plastic bag dispenser. The bag dispenser holds a series of bags where one bag is connected at its bottom end to the top of the next bag, but where a line of perforations and a slot facilitate separation of the bags. Additionally, the series of bags is rolled onto a core, so that they may be supported and dispensed as the bags are unrolled. The perforations may be a row of small holes or short slits. The slot is a larger slit in the line of perforations. The perforations and slot define the end of one bag and the start of the next bag. The dispenser is for use with such bags or other articles that are similarly joined, such as paper or cloth towels.

The bag dispenser comprises a support frame, a pair of braking devices, and a separating device. The support frame consists essentially of a base plate and a chrome plated wire frame. Additionally, the wire frame is formed into a pair of channels to support the core so that it can rotate freely in place in the channels.

In a preferred embodiment, the two braking devices are attached to the support frame to retard the rotation of the series of bags so that the roll of bags does not unravel if pulled too hard. First, there is a braking bar positioned transverse to the roll of plastic bags running from channel to channel parallel to the axis of the core on which the series of bags is wound. This bar supports the series of bags while the channels guide the core's descent as the roll of bags is used up. The second braking device consists of two fingers each attached to one of the channels. As the bags are removed from the roll, the core descends in the channels and the core's edges come into engagement with the two fingers, adding frictional braking to the core, retarding its rotation.

The separating device comprises a wire carriage carrying a projection with a top and a bottom in spaced relation to and supported by the support frame, and in particular to the breaking bar of the support frame. The projection is preferably diamond shaped, angled toward the series of bags and is designed to engage the slot between each bag to separate each bag from the next bag. The wire carriage is attached or possibly made integral to the support frame and, in its preferred embodiment, is coiled to function as a spring.

An important feature of this invention is the two-sided projection carried by the wire carriage. By having a two-sided projection, the slot in the perforation between bags will engage the projection regardless of whether a bag is pulled across the top or the bottom of the projection. This feature allows the bag dispenser to be mounted in a variety of positions and allows the user to easily pull the bag over or under the projection to separate the bag.

Another feature of the present invention is the wire carriage. As the user pulls the bag over or under the projection, the tension caused by pulling a bag over the projection and the retarded roll of bags causes the carriage to deflect. This deflection continues until the projection engages the slot, at which point the carriage and projection recoil from the deflected position through their normal position to facilitate the separation of the two bags by the "snap" of the recoil.

Yet another feature of the present invention is the dual function of the braking bar. By placing the bar directly below the bags, the bar actually supports the weight of the roll. When the bags are being dispensed from the roll, the next bag of the series of bags is pulled from the bottom of the roll, between the roll and the breaking bar. Therefore the weight of the roll increases friction of the next bag being pulled between the roll and the bar. Moreover, the location of the bar establishes one end of a moment arm; the other end is the projection on the wire carriage. This moment arm which in part determines the spring forces that deflect the wire carriage is then a constant regardless of whether it is the first or the last bag being dispensed.

Still another feature of the present invention is the two fingers attached to each channel. As the bags are removed from the roll, the weight of the roll decreases and thus, the amount of tension the braking bar provides to the bags decreases as well. However, as the core descends within the channels, the core's edges come into engagement with the two fingers on each side steadily increasing friction to the core in order to retard its rotation and subsequent unraveling. The increase in friction provided by the two fingers also helps maintain a sufficient and relatively consistent tension in the series of bags so that the separating device will deflect.

Yet another feature of the present invention is the use of chrome plated wire for the frame. Chrome plated wire is aesthetically pleasing and blends in with the decor of a supermarket. Furthermore, chrome plated wire remains relatively clean, but is also easy to clean if necessary.

Other features and advantages of the present invention will be apparent to those skilled in the art from a careful reading of the Detailed Description Of A Preferred Embodiment accompanied by the following drawings.

DETAILED DESCRIPTION OF A PREFERRED EMBODIMENT

Figure 1:
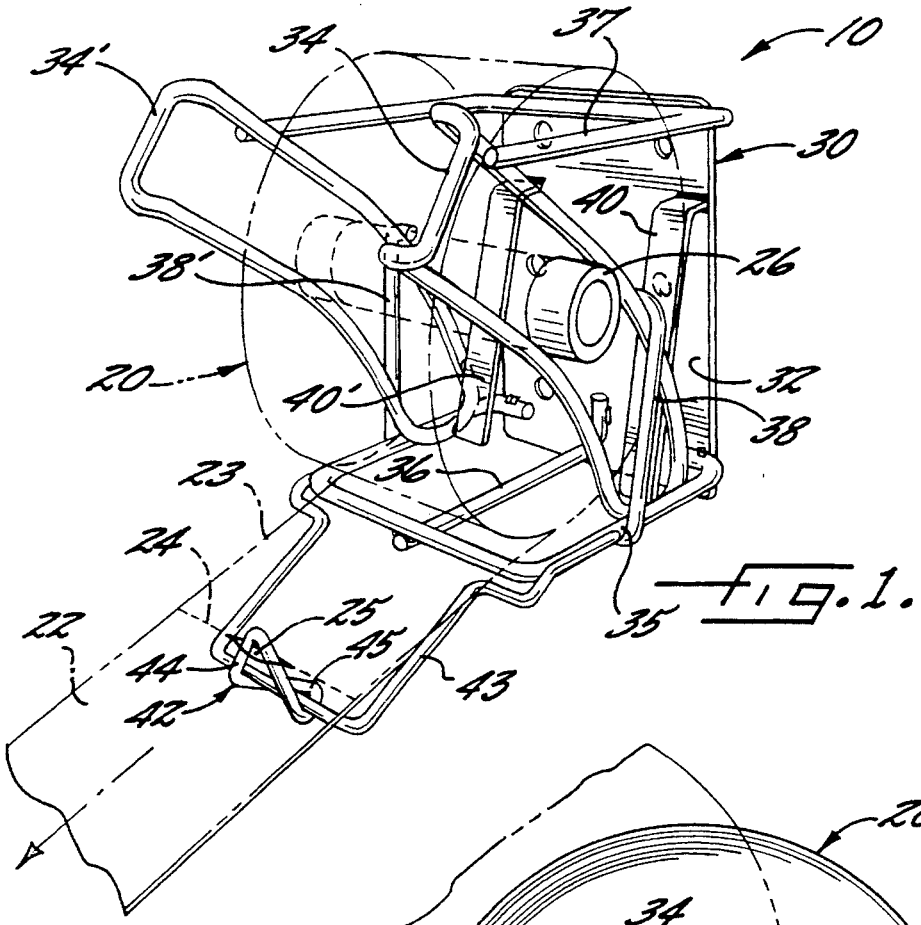
FIG. 1 is a perspective view of the bag dispenser according to the preferred embodiment of the present invention with a bag being pulled over the separating device.
Figure 2:
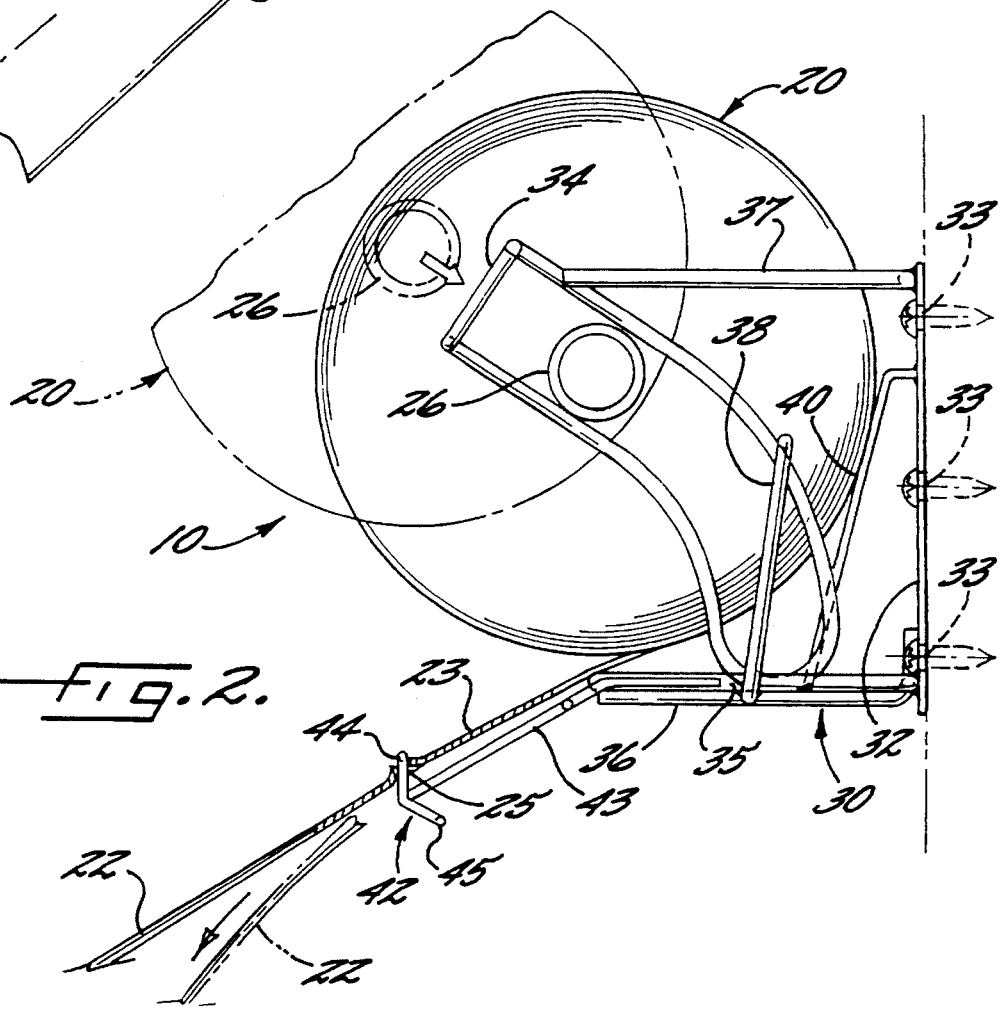
FIG. 2 is a perspective view of the bag dispenser according to the preferred embodiment of the present invention with a bag being pulled under the separating device.
Figure 3:
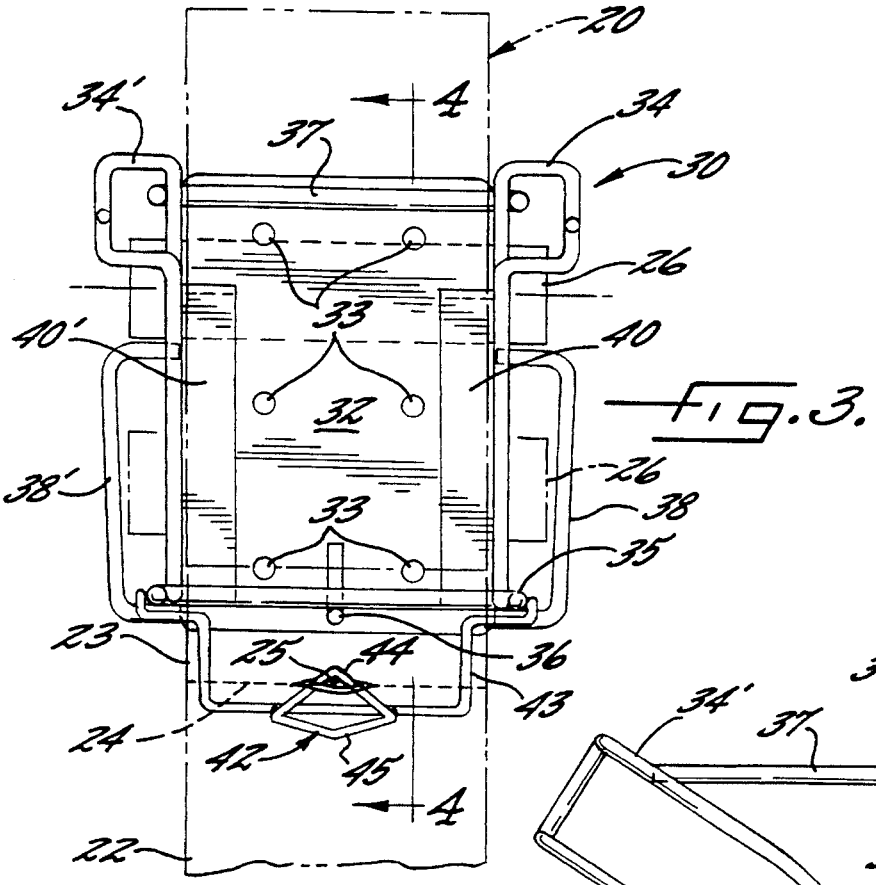
FIG. 3 is a front view of the bag dispenser with a full roll of bags according to the preferred embodiment of the present invention.
Figure 4:
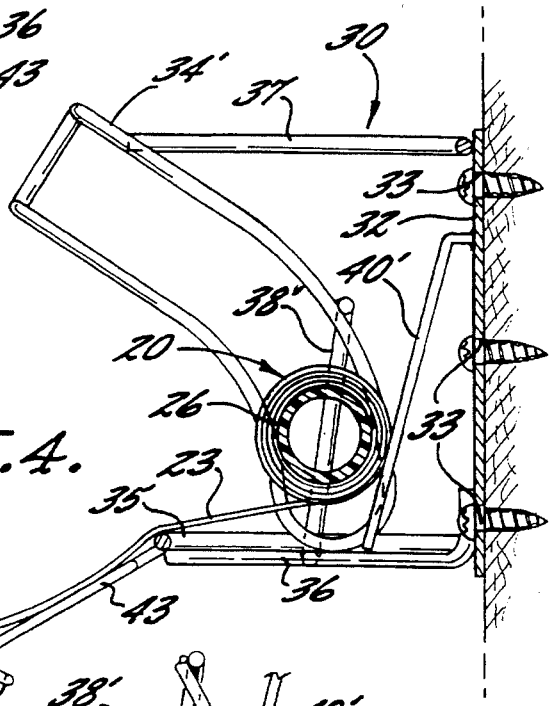
FIG. 4 is a cross-sectional view of the bag dispenser along lines 4—4 of FIG. 3.

In the following description similar components are referred to by the same reference numeral in order to simplify the understanding of the sequential aspect of the drawings.

Now referring to FIGS. 1, 2, 3, and 4, a bag dispenser 10 in its preferred embodiment is used with a series of bags 12 where an end of a first bag 20 is connected to the top of a next bag 22 by perforation lines 14 with a slot 16 therebetween. Additionally, series of bags 12 is rolled onto a core 18 to form a roll.

Bag dispenser 10 comprises a support frame 30 and a separator 50. Support frame 30 consists essentially of a base plate 32 and a wire frame 34. Base plate 32 is a thin metallic plate with a plurality of holes 38 suitable for mounting bag dispenser 10 to a variety of surfaces. Wire frame 34 is formed to make a pair of channels 36 to hold core 18. Channels 36 are dimensioned to allow core 18 to rotate freely in place, but restricts core's 18 linear movement to the vertical direction. In its preferred embodiment wire frame 34 is constructed from chrome plated wire. Chrome plated wire is aesthetically pleasing and it is also easy to clean, a requirement in the food industry.

Separator 50 is also constructed of chrome plated wire and is curved at an attachment end 52 to connect to wire frame 34 near base plate 32. Optionally, separator 50 could be made integral to support frame 30. At approximately the middle of separator's 50 length is an optional coil 54 that acts as a spring. After coil 54, separator 50 extends downward away from wire frame 34. Located at the end of separator 50 is projection 70 which has a top 72 and a bottom 74 and is preferably a diamond shaped wire attached to separator 50 at its midsection (best seen in FIG. 3 and 4). Projection 70 is dimensioned so that as first bag 20 is pulled across projection 70, slot 16 engages it. Projection 70 has top 72 and bottom 74 so that first bag 20 may be pulled either across top 72 of projection 70 or across bottom 74 of projection 70 and still have top 72 or bottom 74 engage slot 16, respectively. Projection 70 is preferably bent inwardly frown its attachment point, so that top 72 and bottom 74 each form an acute angle between separator 50 and itself. Furthermore, to accommodate the variety of orientations for bag dispenser 10, separator 50 may be angled differently to better allow slot 16 engage projection 70. Therefore, bag dispenser 10 may be mounted vertically, horizontally, or in another position by simply changing the angle of separator 50, which may be done by interchanging separator 50 with a different one or by bending separator 50 to the desired angle.

In a second embodiment of the present invention, separator 50 does not contain a coil. Without the coil present, top 72 and bottom 74 of projection 70 still operate to engage slot 16 regardless of whether first bag 20 is pulled across top 72 or across bottom 74 of projection 70. In operation, projection 70 will engage slot 16 stopping next bag 22, so that the user may easily separate the two bags without having to locate perforation lines 14; projection 70 simply enters slot 16 stopping next bag 22 but allowing first bag 20 to be separated from next bag 22.

Attached to wire frame 34 are two braking devices, a braking bar 80 and a pair of fingers 60. (Best seen in FIG. 3.) Braking bar 80 is attached to wire frame 34 so that it is positioned transversely to and directly underneath core 18 of series of bags 12. Braking bar 80 supports the weight of series of bags 12 so that as a bag is being dispensed, the weight of series of bags 12 against braking bar 80 acts to retard the dispensing of series of bags 12. Fingers 60 are each attached to the inside of channels 36 at their top 62 but free from attachment at their bottom 64. (Best seen in FIG. 4.) Fingers 60 are positioned so that as the bags are removed from series of bags 12, core 18 descends within channels 36 so that core's 18 edges come into engagement with fingers 60. The edges of engagement are defined as the two flat ends of the hollow right cylinder known as core 18. As core 18 descends, fingers 60 increase the amount of friction to core 18 thus retarding its rotation. Additionally, fingers 60 are bent to form an angle 66 at about one-quarter of its length from bottom 64, so that when series of bags 12 is low, angle 66 fits inside the end of core 18.

Figure 5:
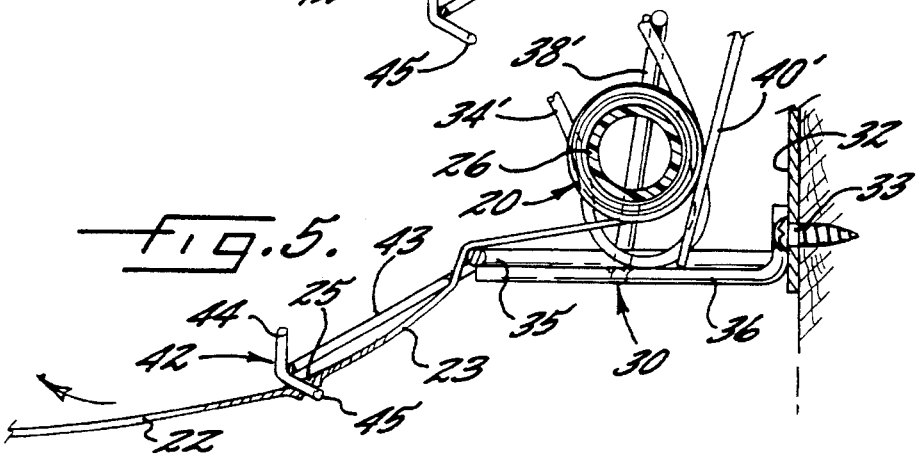
FIG. 5 is a front view of the bag dispenser with a nearly empty roll of bags according to the preferred embodiment of the present invention.

Braking bar 80 and fingers 60 act in combination to apply a tension to first bag 20 and next bag 22. When the roll is full, series of bags 12 has enough weight to pinch next bag 22 between series of bags 12 and braking bar 80 so that a sufficient amount of tension is provided for separator 50 to deflect. When the amount of bags in series of bags 12 decreases, the amount of tension created by the weight of series of bags 12 decreases as well. However, fingers 60 engage the edge of core 18 when the number of bags decreases, thus increasing the friction to core 18 and retarding its rotation. (See especially FIG. 5). Therefore, when there are fewer bags in series of bags 12, the retardation provided by both braking bar 80 and fingers 60 acts to maintain a level of tension sufficient for separator 50 to deflect. Additionally, by retarding the rotation and dispensing of series of bags 12, braking bar 80 and finger 60 prohibit series of bags 12 from unraveling uncontrollably.

In operation, a user takes first bag 20 in hand and pulls it either over or under projection 70 creating a tension in first bag 20 and next bag 22. The tension created in the bags causes separator 50 to deflect up or down depending on the orientation of the bags. (See especially FIG. 4.) The user continues to pull first bag 20 until projection 70 snaps into slot 16, thus stopping next bag 22 and facilitating the tearing or first bag 20 along perforation lines 14 as separator 50 recoils from its deflected position through its normal position. The addition of the recoil force applied by separator 50 helps to separate the two bags and decreases the amount of force the user must apply. Additionally, the application of the recoil force from separator 50 on next bag 22 will lift next bag 22 so that it will be easy to grab by the next user.

It will be apparent to those skilled in the art that many modifications and substitutions can be made to the foregoing preferred embodiment without departing from the spirit and scope of the present invention, which is defined by the appended claims.

What is claimed is:

1. An apparatus for dispensing articles wherein each article is attached to a next article to form a series of said articles, said each article of said series of articles and said next article in said series of articles having perforations with a slot therebetween for separating said each article from said next article, said series of articles rolled onto a core, and means for supporting said series of articles; said apparatus comprising:

a projection having a top portion and a bottom portion and spaced apart from said series of articles for engaging said slot between said each article and said next article of said series of articles regardless of whether said series of articles is brought over said top portion of said projection or over said bottom portion of said projection, said projection further comprising a symmetrical wire, diamond shaped, acutely angled towards said series of articles.

2. The apparatus as recited in claim 1, wherein said projection deflects as said series of articles is drawn across said projection until said projection engages said slot, whereupon said projection enters said slot, stopping said next article and tearing said each article from said next article at said perforations so that said each article and said next article are separated.

3. An apparatus for dispensing articles wherein each article is attached to a next article to form a series of said articles, said each article of said series of articles and said next article in said series of articles having perforations with a slot therebetween for separating said each article from said next article, said series of articles rolled onto a core having two ends, said apparatus comprising:

a pair of channels for holding said core so that said core can rotate in place as said series of articles is drawn over said a projection having a top and a bottom;

a projection spaced apart from said series of articles for engaging said slot between said each article and said next article of said series of articles regardless of whether said series of articles is brought over said top of said projection or over said bottom of said projection for separating said each article from said next article in said series of articles along said perforations as said series of articles is drawn across said projection, said projection further comprising a symmetrical wire, diamond shaped, and acutely angled towards said series of articles.

4. A device for dispensing articles wherein each article is attached to a next article to form a series of said articles, said each article of said series of articles and said next article in said series of articles having perforations with a slot therebetween for separating said each article from said next article, said series of articles rolled onto a core having two ends, said device comprising:

a pair of channels for holding said core so that said core can rotate in place within said channels;

a projection for engaging said slot of said next article of said series of articles so that said each article can be separated from said next article along said perforations;

first means for retarding rotation of said series of articles; and second means carried by said channels for retarding rotation of said core, said second retarding means further comprises a pair of bars carried by said channel means, said core coming into engagement with said pair of bars as said series of articles is drawn across said projection.

5. A device for dispensing articles wherein each article is attached to a next article to form a series of said articles, said each article of said series of articles and said next article in said series of articles having perforations with a slot therebetween for separating said each article from said next article, said series of articles rolled onto a core having two ends, said device comprising:

a pair of channels for holding said core so that said core can rotate in place within said channels;

a projection for engaging said slot of said next article of said series of articles so that said each article can be separated from said next article along said perforations;

first means for retarding rotation of said series of articles; and second means carried by said channels for retarding rotation of said core, said second retarding means further comprises a pair of bars carried by said channel means, said bars positioned at an angle so that said bars apply increasing pressure against said ends of said core as said articles are dispensed from said device.

6. A device for dispensing articles wherein each article is attached to a next article to form a series of said articles, said each article of said series of articles and said next article in said series of articles having perforations with a slot therebetween for separating said each article from said next article, said series of articles rolled onto a core having two ends, said device comprising:

a pair of channels to support both ends of said core so that said core can rotate in place within said channels;

a projection for separating said each article from said next article of said series of articles, said projection in spaced relation to said series of articles, said projection having a deflected position when said series of articles is being drawn across said projection and a normal position when said series of articles is not being drawn across said projection, said projection being in said deflected position until said projection engages said slot, said projection tearing said perforations when moving from said deflected position through said normal position, said projection further comprises a symmetrical wire, diamond shaped, acutely angled towards said series of articles.

* * * * *

UNITED STATES PATENT AND TRADEMARK OFFICE

CERTIFICATE OF CORRECTION

PATENT NO. : 5,556,019

DATED : September 17, 1996

INVENTOR(S) : Joseph W. Morris

It is certified that error appears in the above-identified patent and that said Letters Patent is hereby corrected as shown below:

In the Drawings :

Please delete the drawings, Figures 1-5, and insert the following drawings therefor:

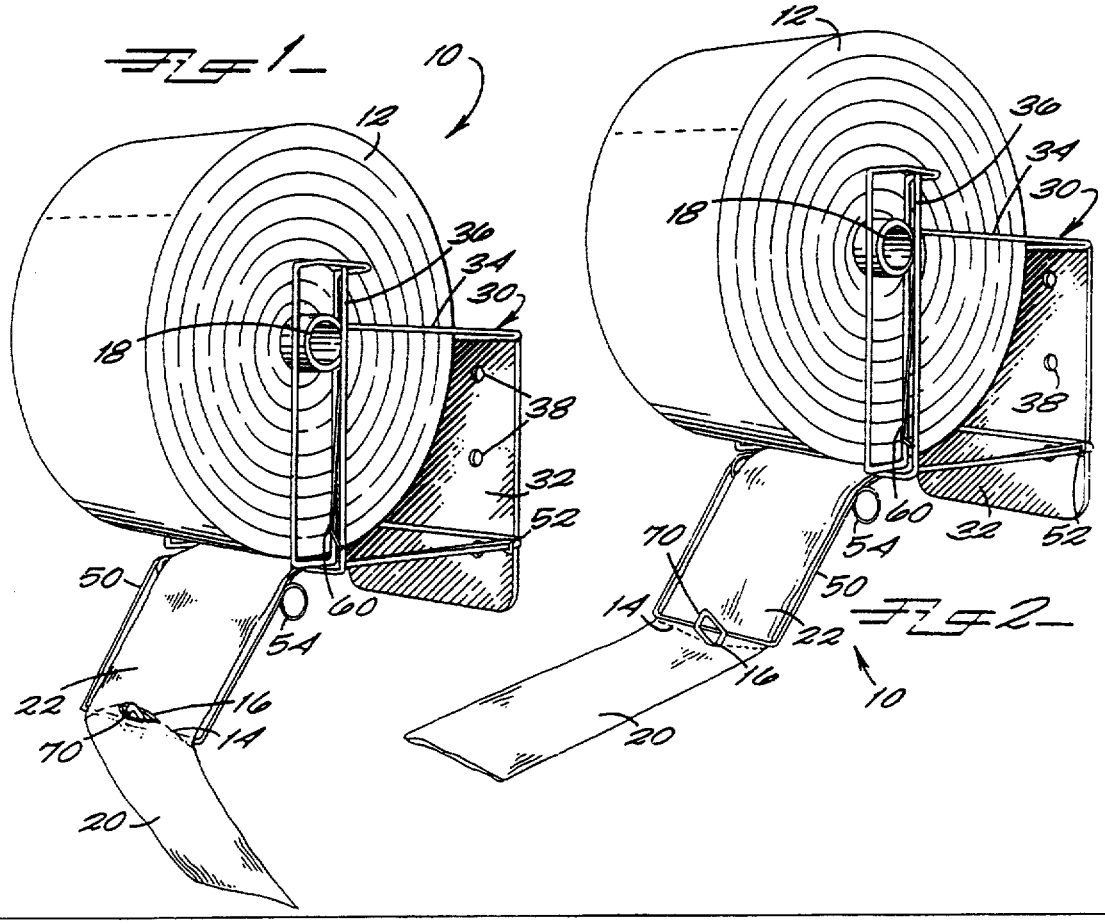

UNITED STATES PATENT AND TRADEMARK OFFICE

CERTIFICATE OF CORRECTION

PATENT NO. : 5,556,019

DATED : September 17, 1996

INVENTOR(S) : Joseph W. Morris

It is certified that error appears in the above-identified patent and that said Letters Patent is hereby corrected as shown below:

Please delete the drawings, Figures 1-5, and insert the following drawings therefor:

FIG 3

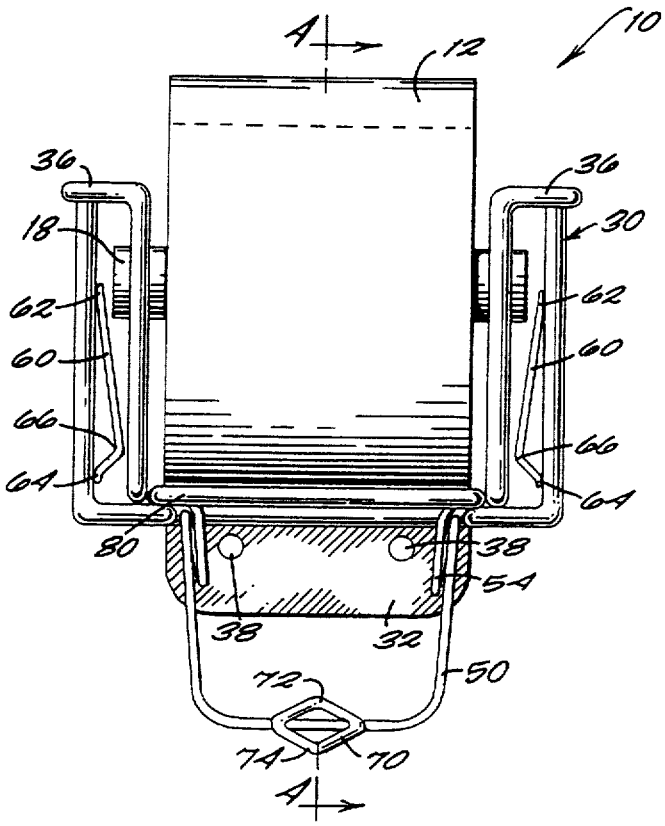

UNITED STATES PATENT AND TRADEMARK OFFICE

CERTIFICATE OF CORRECTION

PATENT NO. : 5,556,019

DATED : September 17, 1996

INVENTOR(S) : Joseph W. Morris

It is certified that error appears in the above-identified patent and that said Letters Patent is hereby corrected as shown below:

Please delete the drawings, Figures 1-5, and insert the following drawings therefor:

FIG. 4

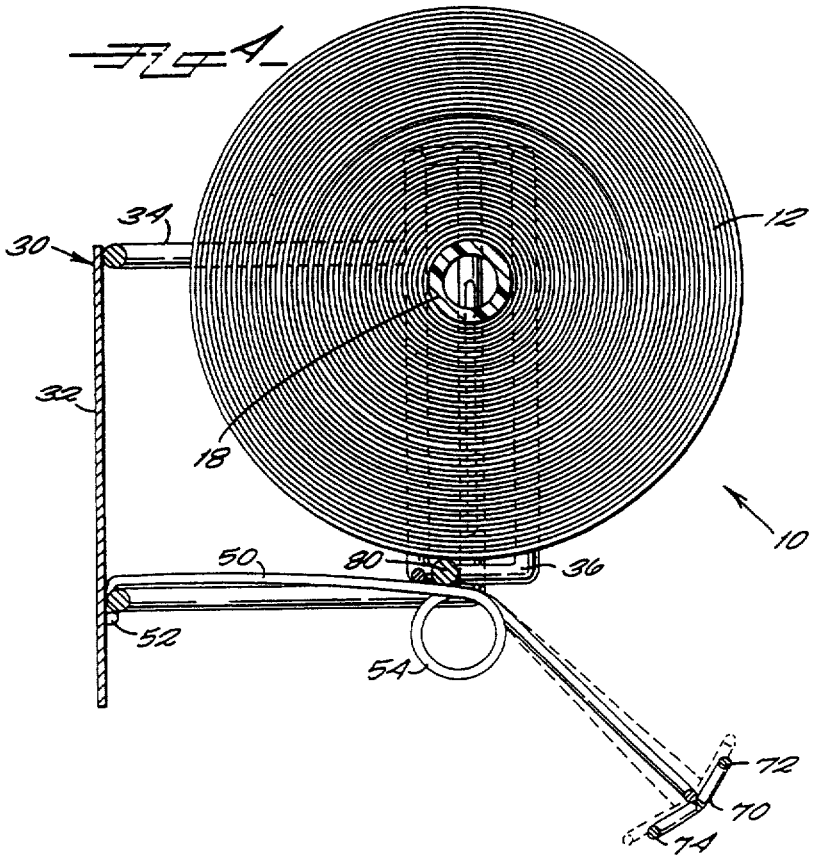

UNITED STATES PATENT AND TRADEMARK OFFICE

CERTIFICATE OF CORRECTION

PATENT NO. : 5,556,019

DATED : September 17, 1996

INVENTOR(S) : Joseph W. Morris

It is certified that error appears in the above-identified patent and that said Letters Patent is hereby corrected as shown below:

Please delete the drawings, Figures 1-5, and insert the following drawings therefor:

FIG 5

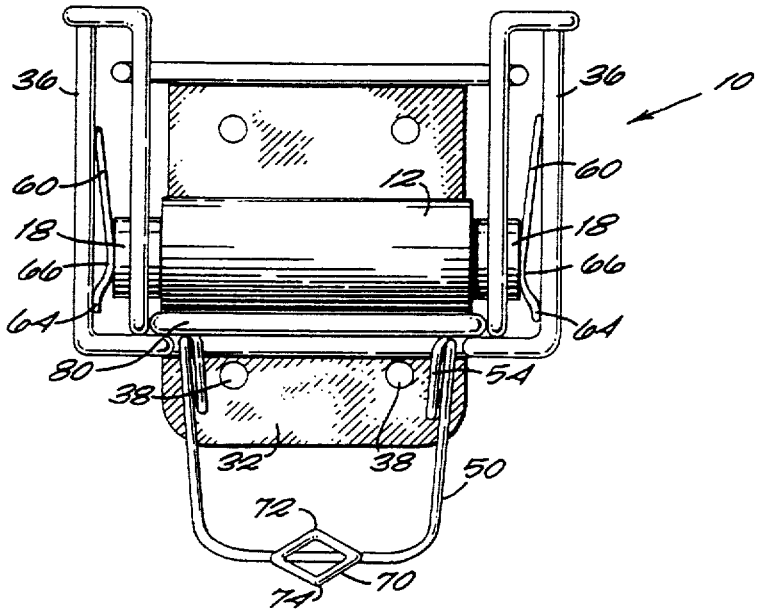

UNITED STATES PATENT AND TRADEMARK OFFICE

CERTIFICATE OF CORRECTION

PATENT NO. : 5,556,019

DATED : September 17, 1996

INVENTOR(S) : Joseph W. Morris

It is certified that error appears in the above-identified patent and that said Letters Patent is hereby corrected as shown below:

Column 1, line 25, delete "frown" and insert -- from -- therefor.

Column 2, line 14, delete "breaking" and insert -- braking -- therefor.

Column 2, line 42, delete "breaking" and insert -- braking -- therefor.

Column 3, line 64, delete "frown" and insert -- from -- therefor.

Column 4, line 1, after "16" insert -- to --.

Column 5, line 40, omit "said".

Column 5, line 41, delete "a" and insert -- said -- therefor.

Signed and Sealed this

Fourth Day of February, 1997

Bruce Lehman

*Attest:*

BRUCE LEHMAN

*Attesting Officer*

*Commissioner of Patents and Trademarks*